US005298371A

United States Patent [19]

Nakamura

[11] Patent Number: 5,298,371

[45] Date of Patent: Mar. 29, 1994

[54] METHOD FOR PROCESSING A SILVER HALIDE PHOTOGRAPHIC LIGHT-SENSITIVE MATERIAL

[75] Inventor: Takashi Nakamura, Kanagawa, Japan

[73] Assignee: Fuji Photo Film Co., Ltd., Kanagawa, Japan

[21] Appl. No.: 932,966

[22] Filed: Aug. 20, 1992

[30] Foreign Application Priority Data

Aug. 22, 1991 [JP] Japan ..... 3-235392

[51] Int. Cl.[5] ..... G03C 5/44; G03C 5/395

[52] U.S. Cl. ..... 430/393; 430/400; 430/418; 430/460

[58] Field of Search ..... 430/393, 398, 399, 400, 430/418, 460

[56] References Cited

U.S. PATENT DOCUMENTS 4,014,764 3/1977 Seiler et al. ..... 430/400

4,036,715 7/1977 Baden et al. ..... 430/400

4,128,464 12/1978 Idota ..... 430/400

*Primary Examiner*—Charles L. Bowers, Jr.

*Assistant Examiner*—Mark F. Huff

*Attorney, Agent, or Firm*—Sughrue, Mion, Zinn, Macpeak & Seas

[57] ABSTRACT

There is disclosed a method for processing a silver halide light-sensitive material in which processing can be carried out while maintaining and controlling the processing performance of a bleach-fixing solution. This results in making it possible to reduce the amount of the bleach-fixing solution used. The method comprises subjecting an image-wise exposed silver halide light-sensitive material to bleach-fixing processing in a bleach-fixing solution after a color development processing, wherein a bath containing the bleach-fixing solution is divided into plural parts by at least one anion exchange membrane wherein an anode and a cathode are disposed in different parts so that electrification can be carried out between the anode part and the cathode part.

7 Claims, 7 Drawing Sheets

METHOD FOR PROCESSING A SILVER HALIDE PHOTOGRAPHIC LIGHT-SENSITIVE MATERIAL

FIELD OF THE INVENTION

The present invention relates to a method for bleach-fixing processing a silver halide photographic light-sensitive material (hereinafter referred to as a light-sensitive material).

BACKGROUND OF THE INVENTION

A color light-sensitive material is subjected to processing at the steps of color developing, desilvering, rinsing, and stabilizing after exposing. There are used a color developing solution for color developing, a bleaching solution, a bleach-fixing solution and a fixing solution for desilvering, city water or ion-exchanged water for rinsing, and a stabilizing solution for stabilizing, respectively. The respective processing solutions are usually adjusted to a temperature of 20° to 50° C., and the light-sensitive material is dipped in these processing solutions and processed.

Of the above processing steps, the color developing and desilvering processings are basic. At the color developing step, a developing agent, which is a reducing agent, acts on exposed silver halide grains contained in the light-sensitive material to reduce $Ag^+$ to Ag, and at the same time, an oxidation product of a developing agent is reacted with a coupler to form a dye image corresponding to a silver image. At the subsequent desilvering step, silver formed by the development is oxidized by a bleaching agent, which is an oxidizing agent, to convert it to silver halide, which is dissolved and removed with a fixing agent, which is a silver halide solvent, whereby only the dye image is formed.

This desilvering step includes a bleaching step and fixing step. There is available a method in which these steps are carried out in the same bath or different baths, and a method in which the bleaching step and bleach-fixing step are carried out in different baths.

Accordingly, the bleach-fixing step in which the bleaching step and fixing step are carried out in the same bath is used in various modes at the processing step of the color light-sensitive material. In particular, in a light-sensitive material which is relatively susceptible to desilvering, such as a color paper, a method in which only the bleach-fixing step is carried out as the desilvering step is applied in many cases. In the processing in which only the bleach-fixing step is carried out as the desilvering step, the number of the processing baths can be decreased, and has an advantage that a replenishing solution can be decreased, since only one kind of the replenishing solution is used. In addition, compared with the case in which both the bleaching solution and fixing solution are used, the problem that the solutions are mistakenly charged does not arise, and therefore, this is more suited to processing by unskilled persons.

There can be given as a bleaching agent contained in such a bleach-fixing solution, a ferric complex, such as aminopolycarboxylic acid, aminopolyphosphonic acid, and the salts thereof. To be representative, a ferric ethylenediaminetetraacetate complex salt is widely used. In addition thereto, a ferric 1,3-diaminopropanetetracetate complex salt is available as a bleaching agent having a high oxidizing power. Meanwhile, thiosulfate is available as a fixing agent.

Accordingly, in such a bleach-fixing solution, an iron (II) salt and a silver complex ion are accumulated as the processing proceeds, so that the activity thereof is lowered.

In addition, a fixing agent and a preservative contained in a bleach-fixing solution are susceptible to air oxidation by aging while the solution is not used for processing a light-sensitive material. These agents are decomposed to generate a sulfurization, so that a problem, such as a stain on a surface of the light-sensitive material, is caused.

In order to prevent such reduction of activity and the afore-mentioned problem, there is employed a method in which a suitable amount of a replenishing solution is added to a bleach-fixing solution and an old solution is discharged as an overflow. However, the increase in the replenishing amount results in an increase in the amounts of agents and water employed. This is not preferable from the viewpoint of saving the resources and the reduction of a waste water amount, which are intensively required in recent years from the standpoint of environmental maintenance. In addition, it is disadvantageous in terms of cost.

Further, in order to recover an oxidizing power, there is employed, for example, a method in which a bleach-fixing solution is subjected to aeration to increase an oxidation-reduction potential of the solution.

However, the application of such a method generates a foam in the solution, which results in causing problems, such as stain on the surroundings caused by the solution spilling over from a bleach-fixing bath and stain of the processing solution contained in a preceding bath by splashing into the preceding bath due to foaming. In particular, the processing solution contained in the preceding bath is a color developing solution in many cases, and therefore, the color developing solution is deteriorated. Thus, the developing power is reduced, which in turn results in causing a serious problem. In addition, there is involved another problem in that a fixing agent and a preservative are decomposed by aeration to deteriorate the fixing power.

Meanwhile, there can be given as a method for recovering a processing performance of a fixing solution, an electrolysis method in which silver is deposited on a cathode of an electrolysis equipment, and the short components are replenished to the solution after removing silver for reuse. However, the application of this method to a bleach-fixing solution causes a complicated reaction, and therefore regeneration does not necessarily go well.

Under such circumstances, there has been proposed a method in which an anion exchange membrane is applied for electrolysis to maintain and recover the processing performance of the processing solution [JP-A-3-273237 (the term "JP-A" as used herein means an unexamined published Japanese patent application)].

However, the direct application of the above method creates a problem since a bleach-fixing solution contains a bleaching agent, being a component in which the performance can be recovered by oxidation, and a fixing agent, being a component in which the performance can be recovered in a reduction condition. Accordingly, various improvements are required.

The recovery of silver is generally carried out in order to recover the performance of the fixing solution, and this method can be applied to a bleach-fixing solution.

Examples of such methods for recovering silver include:

1) a method (a metal substitution method) in which metal having an ionization tendency larger than that of silver is contacted to the solution;

2) a method (a settling method) in which a reagent for forming an inactive silver salt is added and a reduction settling method is used;

3) a method (an ion exchange method) in which an ion exchange resin is used; and 4) a method (an electrolysis method) in which silver is deposited on a cathode of an electrolysis equipment. The details on these methods are described in "Present Status of Silver Recovery in Motion-Picture Laboratories" written by M. L. Schreibe, J. SMPTE, 74, pp. 504 to 514 (1965).

Meanwhile, methods available for recovering the oxidizing power of a bleaching agent include: 1) a method in which an oxidizing agent is added (for example, U.S. Pat. Nos. 3,615,507 and 3,767,401, and German Patent Application (OLS) 2149314);

2) a method involving the contacting of oxygen (air) (for example, U.S. Pat. Nos. 3,634,088 and 3,700,450, and German Patent Application (OLS) 2113651); and 3) an electrolytic oxidation method (for example, JP-A-48-18191).

Of the above methods, the electrolysis method is paid attention to as a method for recovering both the bleaching power and fixing power of the bleach-fixing solution. However, where this method is applied, an iron (III) complex, which is an oxidizing agent, is reduced to an iron (II) complex before a silver complex ion is reduced to silver. Thus, when a bleach-fixing solution is prepared, the oxidizing power thereof is lowered, or silver is reoxidized in the presence of the iron (III) complex. Accordingly, an electrode reaction does not necessarily go on in a favorable direction in terms of the recovery of the processing performance, and a complicated reaction takes place, which makes this method rather impractical.

From such a point of view, there is disclosed in JP-B-57-16345 (the term "JP-B" as used herewith means an examined Japanese patent publication), a method in which a carbon fiber is used for an anode alone or together with other materials for an anode, and gas containing oxygen, such as air, is blown in a vicinity of the anode to electrolytically regenerate the bleach-fixing solution.

In this method, the oxidizing power of a bleaching agent is recovered not only by electrolytic oxidation but also by blowing air. If the electrolysis method is applied not only to the oxidation of an iron (III) ion, but also to the recovery of silver, the reduction of the iron (III) ion, as well as the reduction of a silver complex ion, takes place at a reduction step. While a large oxidizing power is needed for the anode, it is said that the anode provided with a large oxidizing power can improve the problem that the preservative and the fixing agent are oxidized.

Even in such the method, however, there can not be overcome the problems that the preservative and fixing agent are susceptible to oxidation on the anode side by blowing air, and that reduction of the iron (III) ion takes place on the anode side. As a result, further improvements are desired.

SUMMARY OF THE INVENTION

An object of the present invention is to provide a method for processing a silver halide light-sensitive material, in which the processing can be carried out while easily maintaining and controlling the processing performance of a bleach-fixing solution, which results in making it possible to reduce the amount of the bleach-fixing solution used while maintaining its photographic performances.

The above object of the present invention can be achieved by a method consisting of the following processings (1), (2) or (3). That is, the method for processing a silver halide light-sensitive material, in which an exposed silver halide light-sensitive material is subjected to a bleach-fixing processing in a bleach-fixing bath containing a bleach-fixing solution after color developing processing, is characterized in that:

(1) said bleach-fixing bath containing the bleach-fixing solution is divided into plural parts along the path of the carried light-sensitive material by at least one anion exchange membrane, wherein an anode is disposed in the upstream part and a cathode is disposed in the downstream part, and electrification is carried out between the anode and the cathode in the bleach fixing bath during processing of the light-sensitive material;

(2) said bleach-fixing solution is stored in a storing bath after use in the bleach-fixing bath, wherein said storing bath is divided into plural parts by an anion exchange membrane, wherein a cathode is disposed in part (A) which the bleach-fixing solution enters and an anode is disposed in part (B) from which the bleach-fixing solution returns to the bleach-fixing bath wherein the bleach-fixing solution moves from part (A) to part (B); and the bleach-fixing solution stored in said storing bath is subjected to electrification between the anode and the cathode, wherein silver is removed in part (A) and a bleaching agent is regenerated in part (B); or (3) said bleach-fixing bath is divided into plural parts by at least one anion exchange membrane, wherein a first anode and a second cathode are together disposed in the upstream part of said bleach-fixing bath and a first cathode and a second anode are together disposed in the downstream part of said bleach-fixing bath, wherein electrification is carried out between said first anode and said first cathode during processing of the light-sensitive material, and wherein electrification is carried out between said second cathode and said second anode during non-processing.

In electrifying, the processing solutions themselves are either separated by an anion exchange membrane or can be liquid-junctioned with a salt bridge. However, when an ion exchange membrane is not used, resistance between the solutions becomes large with the salt bridge and thus, increases electric consumption. Also, the desired size (dimension) of the electrifying equipment can not be achieved and further, the cost thereof is increased. In addition, the life of the salt bridge is short, and a lot of labor is necessary for maintenance, such as labor for exchanging it. Further, in the salt bridge, the action of halogen ion movement is not demonstrated. Therefore, the effects for regenerating the processing capability and reducing the replenishing amount are reduced.

DETAILED DESCRIPTION OF THE INVENTION

A concrete constitution of the present invention will be explained in detail below.

In bleach-fixing processing of Processing (1) according to the present invention, a light-sensitive material is processed while maintaining and recovering the processing performance of the bleach-fixing solution by electrifying with an anion exchange membrane. In this case, the bleach-fixing solution is preferably filled in plural parts of the bleach-fixing bath so that the bleach-fixing solutions themselves are contacted via the anion exchange membranes. Of these parts, an upstream part, preferably the most upstream part, is equipped with an anode, and a downstream part, preferably the most downstream part, is equipped with a cathode. The electrification is carried out between these electrodes which are paired. This makes it possible to carry out processing in a bleach-fixing solution having a recovered oxidizing power at an upstream part of the bleach-fixing bath and in a bleach-fixing solution having a recovered fixing power at a downstream part of the bleach-fixing bath, which is preferable from the viewpoint of a photographic performance.

Figure 1:
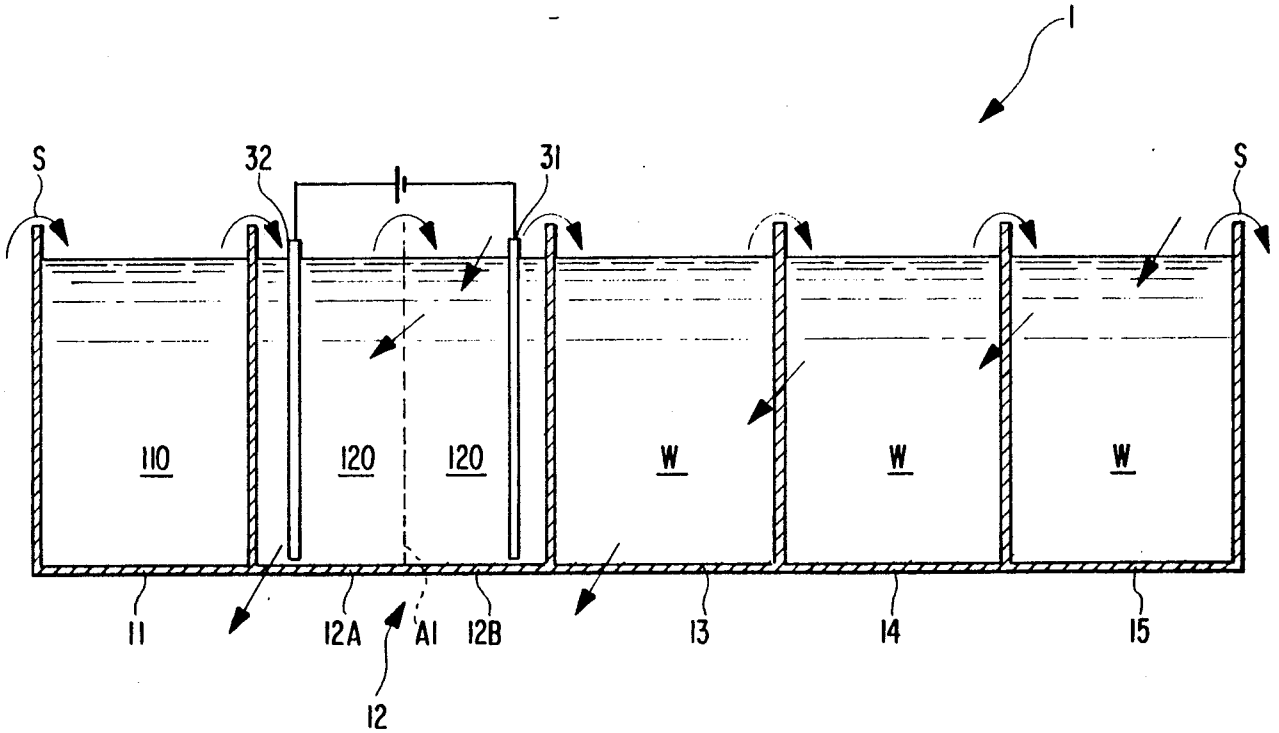
FIG. 1 is a schematic figure showing one structural example of processing equipment used in the present invention.

One constitutional example of a processing equipment used in the present invention is shown in FIG. 1.

As shown in FIG. 1, the processing equipment 1 consists of a color developing bath 11 filled with a color developing solution 110, a bleach-fixing bath 12 filled with a bleach-fixing solution 120, and the first rinsing bath 13, second rinsing bath 14 and third rinsing bath 15, each filled with rinsing water W. A light-sensitive material S such as, for example, a color paper is transported from bath to bath to subject it to a processing in order of color developing, bleach-fixing, rinsing, rinsing and rinsing.

The bleach-fixing bath 12 consists of the upstream part 12A and the downstream part 12B, and a partition wall separating the bleach-fixing solution 120 in the upstream part 12A and the bleach-fixing solution 120 in the downstream part 12B consists of an anion exchange membrane A1.

There are disposed the anode 32 in the upstream part 12A and the cathode 31 in the downstream part 12B, respectively, and both electrodes are of a constitution in which they can be electrified.

In the bleach-fixing bath 12, there is applied a so-called countercurrent replenishing system in which a replenishing solution of the bleach-fixing solution 120 is replenished from the downstream part 12B, and an overflow thereof is sent back to the upstream part 12A to have an overflow from 12A. As described above, the countercurrent replenishing system is preferably applied for replenishing the bleach-fixing solution in Processing (1) according to the present invention.

Also in the first rinsing bath 13, the second rinsing bath 14 and the third rinsing bath 15, there is applied in order to improve a rinsing efficiency, a so-called multi-stage countercurrent system in which rinsing water W is replenished from the third rinsing bath 15 and an overflown solution is replenished in order from a following bath to a preceding bath.

In the constitution of FIG. 1, electrification to the bleach-fixing solution 120 is started as soon as the processing of a light-sensitive material S is started.

The electrification is carried out preferably during the processing. As soon as or a little while after a signal of starting the processing is received, the electrification is started and it is terminated as soon as the processing is over.

In the electrification, the voltage may be loaded so that the electric current density is 0.5 to 300 $mA/cm^2$ (0.05 to 30 $A/dm^2$), preferably 0.2 to 60 $mA/cm^2$ (0.2 to 6 $A/dm^2$). The loaded voltage is entirely different according to the solution used, the form of processing equipment, the distance between the electrodes, and the quality and kind of partition membrane. In general, it is 0.05 to 100 V, preferably 0.1 to 10 V.

The oxidizing power of the bleaching agent is recovered in the bleach-fixing solution 120 in the upstream part 12A by carrying out the electrification, while the fixing power of the fixing agent is recovered in the bleach-fixing solution 120 in the downstream part 12B by disposition of silver on the cathode 31. Also, the generation of sulfides originated from the fixing agent and the deterioration of a preservative are prevented in the bleach-fixing solution 120 in the downstream part 12B. While a halogen ion is removed from the bleach-fixing solution 120 in the downstream part 12B by means of the anion exchange membrane Al, a halogen ion is replenished to the bleach-fixing solution 120 in the upstream part 12A. This prevents the bleach-fixing solution 120 in the downstream part 12B from interfering in fixing. Meanwhile, the bleaching power increases in the bleach-fixing solution 120 in the upstream part 12A without adding a rehalogenating agent.

Accordingly, a bleach-fixing processing close to a bleaching processing can be made in the first half of the bleach-fixing processing and a bleach-fixing processing close to a fixing processing can be made in the latter half of the bleach-fixing processing. Such a processing constitution is preferred in obtaining an excellent photographic performance. In addition, while the bleach-fixing bath consists of plural parts, the solution each first filled in the parts A and B is the same bleach-fixing solution, and therefore there is no concern that an unskilled person mistakenly changes the solutions.

In the upstream part 12A, there is a problem that a fixing agent and a preservative are decomposed due to oxidation. However, the decomposition products thus formed can be overflown from the part 12A and accordingly, this prevents the generation of processing stain.

Figure 2:
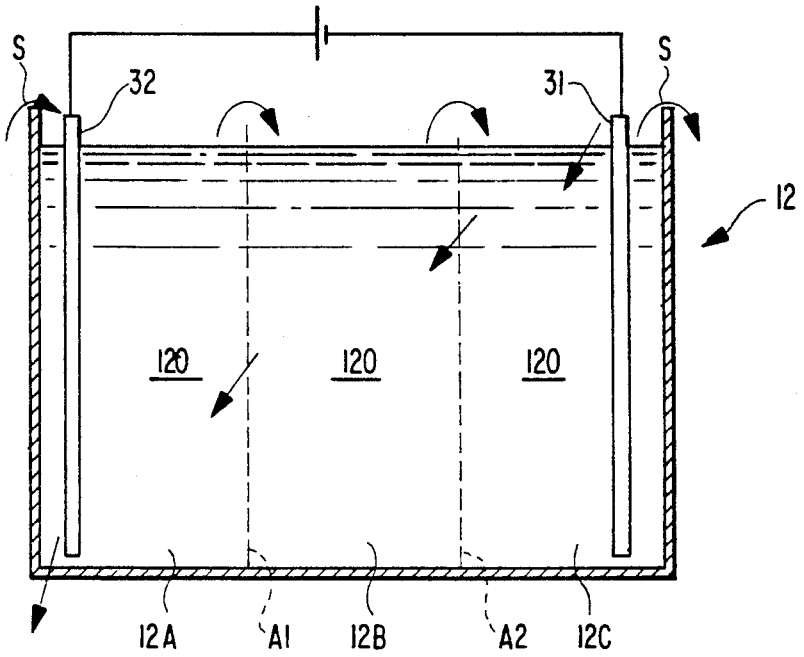
FIG. 2 is a schematic figure showing a bleach-fixing bath portion in a processing equipment used in the present invention.

The processing equipment used in the present invention is not limited to the equipment shown in FIG. 1 and may be one in which the constitution of the bleach-fixing bath 12 is changed as shown in FIG. 2.

The bleach-fixing bath 12 shown in FIG. 2 is the same as the bleach-fixing bath shown in FIG. 1, except that the part 12C is further provided and a cathode 31 is disposed in the part 12C, at the most downstream part, in place of the part 12B and that the bleach-fixing solution 120 in the part 12B and the bleach-fixing solution 120 in the part 12C are separated by the anion exchange membrane A2.

In such the constitution, the same effects as those described above can be obtained.

Figure 3:
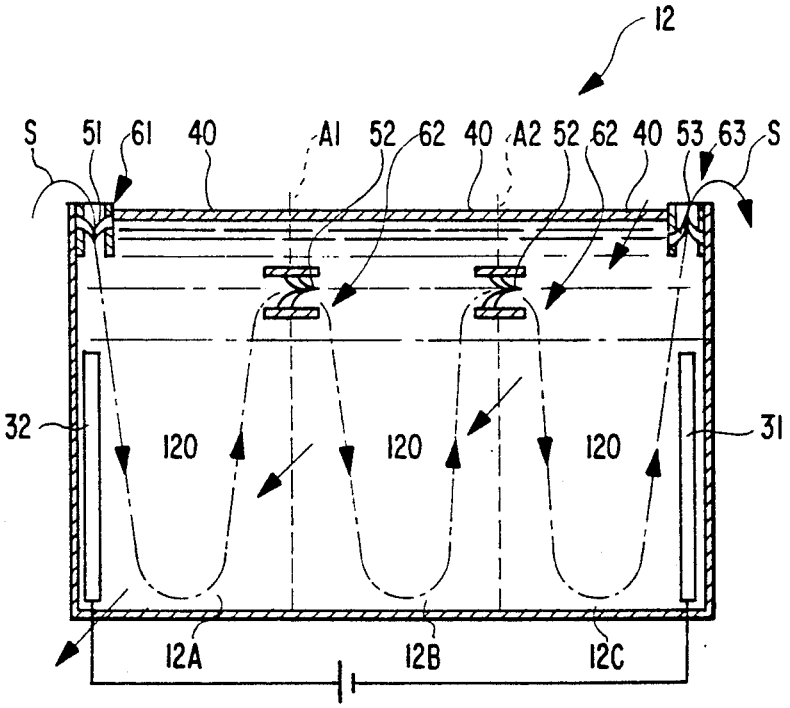
FIG. 3 is a schematic figure showing a bleach-fixing bath portion in a processing equipment used in the present invention.

Also, the constitution of the bleach-fixing bath 12 may be the bath shown in FIG. 3.

The bath shown in FIG. 3 is no different from the bath shown in FIG. 2, except that a transporting path for a light-sensitive material S is shown and the material is prevented from being contacted with air during the bleach-fixing processing and further the bleach-fixing solution 120 is also prevented from being contacted with air.

As shown in FIG. 3, the guide 61 for introducing a light-sensitive material S is provided on the upper part of the inside of the upstream part 12A, and a pair of blades 51 are disposed on a carrying-in path formed by this guide 61 with the end thereof turning downwards. Further, the guide 62 for discharging the light-sensitive material S is provided on the upper part of the most downstream part 12C, and a pair of blades 53 are disposed on a carrying-in path formed by this guide 62 with the end thereof turning upwards.

The liquid surface of the bleach-fixing solution 120 in the upstream part 12A, downstream part 12B and the most downstream part 12C is covered with a liquid surface shutter 40. The particular fluid therefor is not critical as long as it has a specific gravity less than that of the bleach-fixing solution 120, is insoluble in and immiscible with the bleach-fixing solution 120 and does not badly affect the processing performance of the bleach-fixing solution 120. In particular, liquid paraffin and silicon oil are preferably used. The thickness of the liquid surface shutter 40 is preferably 0.1 to 30 mm, particularly 1 to 15 mm.

The carrying-in and carrying-out paths are constituted so that the fluid constituting the liquid surface shutter 40 does not get in. The guides 61 and 63 pass through the liquid surface shutter 40 with the lower ends thereof dipping in the bleach-fixing solution 120 and the upper ends thereof positioning in the air above the liquid surface shutter 40.

The guides 62 for carrying the light-sensitive material S each are disposed also on the partition walls constituted by the anion exchange membranes Al and A2 provided between 12A and 12B and between 12B and 12C. The pairs of the blades 52 each are disposed also on the carrying paths formed by the guides 62. The solutions are prevented from circulating between the respective parts by these pairs of the blades 52.

The pairs of the blades 51, 52 and 53 consist of a flange part which does not substantially deform and a thin wall part (a head part) which decreases gradually in a thickness toward the end thereof and easily deforms by passing of light-sensitive material S. They are installed on the guides 61, 62 and 63, respectively, at the flange parts. The constitutional material therefor may be, for example, various elastomers, such as a natural rubber and a silicon rubber. A contact surface pressure exerted by the thin wall parts themselves is preferably not much more than 0.01 to 0.1 kg/cm$^2$, particularly 0.02 to 0.05 kg/cm$^2$.

The length of a contact surface of the thin wall parts themselves in a light-sensitive material travelling direction in carrying no light-sensitive material is preferably not much more than 0.5 to 10 mm, particularly 1 to 5 mm. The length of the thin wall parts themselves is preferably not much more than 0.5 to 20 mm, particularly 1 to 10 mm.

An average inclined angle of a pair of the blades to the surface of the light-sensitive material S is preferably about 30° to 60°, particularly about 40° to 55°.

The same effects as those described above can also be obtained in such the bleach-fixing bath 12 of the constitution as shown in FIG. 3. In addition, the contact to air is prevented in the respective parts 12A, 12B and 12C. Accordingly better photographic performances can be obtained. Further, the solution carried in from the color developing bath 11 can be decreased by the pair of the blades 51, while the solution carried out to the rinsing bath 13 can be decreased by the pair of the blades 53. Therefore, it is a preferred processing. In addition, there can be obtained, because of the pair of the blades 52, the effect that a reaction with the agents on the emulsion layer of the light-sensitive material S can be accelerated.

The present invention has so far been explained according to the figures shown in the specification, but the processing equipment used for Processing (1) according to the present invention is not limited thereto and may be various ones. It is preferable in obtaining the effect by migration of halogen ion or decreasing the number of electrodes to electrify with the bleach-fixing solutions themselves contacting via an anion exchange membrane as shown in the figures. It also is possible to use an anion exchange membrane in combination with an aqueous solution containing an electrolyte or other processing solutions and dip a pair of the electrodes in these solutions.

In this case, the other processing solution combined with the bleach-fixing solution filled in the upstream part is a color developing solution, and the other processing solution combined with the bleach-fixing solution filled in the downstream part is a rinsing water.

Also, an overflowing solution from a rinsing bath can be utilized as the aqueous solution containing an electrolyte, and in addition, a newly prepared solution also can be used.

In Processing (2) according to the present invention, a bleach-fixing solution after processing is regenerated.

In the above processing, the bleach-fixing storage bath is divided into plural parts by an anion exchange membrane. A cathode is disposed in part (A) to make a cathode part, and an anode is disposed in part (B) to make an anode part wherein the bleach-fixing solution moves from part (A) to part (B). First, the bleach-fixing solution after processing is introduced in the cathode part and the anode part is filled with a fresh bleach-fixing solution. Electricity is allowed to flow between both electrodes to deposit silver on the cathode, whereby silver can be recovered from the bleach-fixing solution after processing. Then, the bleach-fixing solution subjected to the removal of silver is introduced into the anode part and electricity is flown between the electrodes, whereby an oxidizing power of a bleaching agent is recovered in the anode part.

Thus, the bleach-fixing solution which has recovered both of a fixing power and an oxidizing power can be obtained and is reused as a replenishing solution.

The concrete structure of Processing (2) according to the present invention will be explained below in detail.

In Processing (2) according to the present invention, the bleach-fixing solution after processing is reused as a replenishing solution after regenerating. In this case, the regeneration is carried out in such a manner that in the bleach-fixing storage bath divided into at least two parts of an anode part and a cathode part, the used bleach-fixing solution is first introduced in the cathode part to deposit silver on the cathode by electrifying for recovering silver, and the solution from which silver has been removed in turn is introduced in the anode part to recover an oxidizing power of a bleaching agent by electrifying.

Electricity is simultaneously let flow in the cathode part and anode part. Because of this, both parts have to be filled with the solutions. The solution first filled in the anode part may be a fresh bleach-fixing solution.

The bleach-fixing processing in Processing (2) according to the present invention can be a so-called batch system in which some of a light-sensitive material is processed in a fixed amount of a processing solution, but a continuous processing in which a replenishing system is applied is more preferable. In the case of the batch system, the used bleach-fixing solution may be filled in the cathode part. Also, in the continuous processing which is regarded as more preferable, a discharging solution, such as an overflowing solution from the bleach-fixing bath, may be introduced in the cathode part. In such the case, in order to secure a sufficient amount of the solution, the fresh bleach-fixing solution may first be also filled in the cathode part.

Thus, in the anode part, the solution from which silver is removed is subjected to an electrolytic oxidation and accordingly, the reoxidation of silver by a bleaching agent, which is an oxidizing agent, can be prevented. The reduction of the bleaching agent also takes place in the cathode part, but it is reoxidized in the anode part in reusing. Therefore, no problems are involved. Accordingly, the bleach-fixing solution can be efficiently regenerated.

The electrifying amount in the above continuous processing may be decided according to a silver coated amount and processing amount (a replenishing amount of the bleach-fixing solution) of a light-sensitive material, and an amount of a solution carried in from a preceding bath (usually, a color developing bath) by the light-sensitive material.

For example, in the case of a processing in which a light-sensitive material is a color paper and a preceding bath is a color developing bath, assuming that a coated silver'amount is a g/m$^2$, a replenishing amount of the bleach-fixing solution is R ml/m$^2$, an amount of a ferric ion in the replenishing solution is 6 g/1, in which an Fe (III) complex is used as a bleaching agent for the bleach-fixing solution, and a carried-in amount of the color developing solution is C ml per m$^2$ of the light-sensitive material, the electrifying amounts in the cathode and anode are represented by the following equations (1) and (2), respectively:

In the cathode:

$$(900a+10R)\ \text{coulomb} \quad (1)$$

In the anode:

$$(10R+100C)\ \text{coulomb} \quad (2),$$

Accordingly, by calculating according to equations (1) and (2), electricity may flow to both the electrodes employing an electrifying amount of more coulombs, or an electricity may flow according to equation (1). In this case, the voltage may be loaded so that the electric current density becomes 0.01 to 20 A/dm$^2$, preferably 0.1 to 10 A/dm$^2$. The loaded voltage is entirely different according to the solution used, the form of a processing equipment, the distance between the electrodes, and the quality and kind of partition wall. In general, it may be 0.1 to 20 V, preferably 1 to 5 V.

In regenerating the bleach-fixing solution after processing in the above manner in Processing (2) according to the present invention, there may be used either a separate processing unit for regeneration or the anode part for regeneration may also serve as a bleach-fixing bath.

Figure 4:
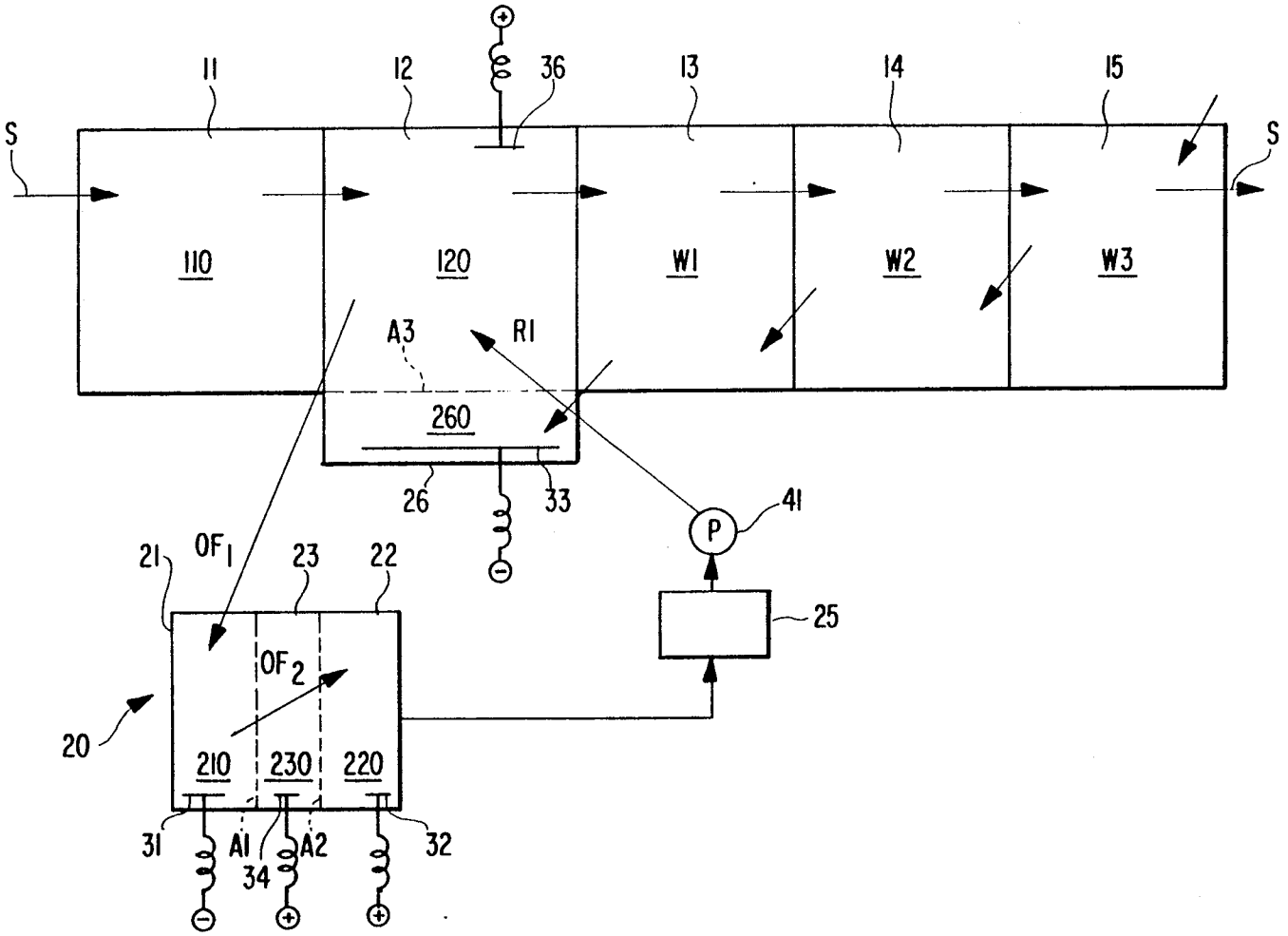
FIG. 4 is a plane figure schematically showing a bath arrangement in a processing equipment used in the present invention.

One constitutional example of the processing equipment used in the present invention is shown in FIG. 4, which is a plane figure showing a bath arrangement. This equipment is provided with a separate processing unit for regeneration (hereinafter referred to as a regenerating unit).

As shown in FIG. 4, the processing equipment 1 consists of the color developing bath 11 filled with the color developing solution 110, the bleach-fixing part 12 filled with the bleach-fixing solution 120, and the first rinsing bath 13, second rinsing bath 14 and third rinsing bath 15 each filled with the rinsing waters W1, W2 and W3. The light-sensitive material S such as, for example, a color paper, is transported from bath to bath to subject it to a processing in order of color developing, bleach-fixing, rinsing, rinsing and rinsing.

The processing equipment 1 is provided with the regenerating unit 20 in which the overflow OF1 coming from the bleach-fixing part 12 is regenerated. The regenerating unit 20 consists of the overflow processing part 21 in which the overflow OF1 is stored and the replenishing solution preparing part 22 in which the solution OF2 of the overflow processing part 21 after electrifying is introduced for storing. The solution part 23 filled with the electrolyte solution 230 containing $NH_4OH$ and others is disposed between the overflow processing part 21 and the replenishing solution preparing part 22, and the partition wall separating the solution 210 in the overflow processing part 21 and the electrolyte solution 230 and the partition wall separating the electrolyte solution 230 and the solution 220 in the replenishing solution preparing part 22 consists of the anion exchange membranes A1 and A2, respectively. Further, there are disposed the cathode 31 in the overflow processing part 21, the anode 34 in the solution part 23 and the anode 32 in the replenishing solution preparing part 22, respectively, and these electrodes are of a constitution in which electrifying is possible.

The solution part 26 filled with the electrolyte solution 260 is disposed in the vicinity of the bleach-fixing part 12, and the partition wall separating the bleach-fixing solution 120 and the electrolyte solution 260 consists of the anion exchange membrane A3. In addition, the anode 36 and the cathode 33 are disposed in the bleach-fixing part 12 and the solution part 26, respectively, and these electrodes are of a constitution in which electrifying is possible. In the bleach-fixing part 12, the regeneration of the bleaching agent is rather important, and such the electrification is effective.

A discharging solution from the first rinsing bath 13 is utilized for the electrolyte solution 260 filled in the solution part 26, and an overflowing solution from the first rinsing bath 13 is allowed to flow in the solution part 26.

Further, there is applied the constitution in which the replenishing of rinsing water starts from the third rinsing bath 15 and an overflowing solution flows in the order, the second rinsing bath 14 and the first rinsing bath 13.

The processing equipment 1 is provided with the storage tank 25 for storing the solution after subjecting it to an electrification treatment in the replenishing solution preparing part 22, and the constitution is applied in which the replenishing solution R1 prepared by adding the agents according to necessity is replenished in the bleach-fixing part 12 via the pump 41.

In the above processing, the electrification is carried out preferably during the processing. As soon as or a little while after a signal of starting the processing of the light-sensitive material S is received, the electrification is started and it is terminated as soon as the processing is over.

The electrifying amount may be calculated based on the above equations (1) and (2) in the regenerating unit 20 and may be set up as described above. Meanwhile, in the bleach-fixing part 12, it may be set up primarily for the purpose of oxidizing a bleaching agent, and a voltage may be loaded so that the electric current density becomes 0.01 to 20 $A/dm^2$, preferably 0.1 to 20 $A/dm^2$ (the loaded voltage is 1 to 5 V).

The solution first filled in the overflow processing part 21 and the replenishing solution preparing part 22 is a fresh bleach-fixing solution as described above.

In the regenerating unit 20, silver is removed from the solution 210 containing the overflow OF1 introduced in the overflow processing part 21 by carrying out the electrification, and then the solution from which silver has been removed is introduced in the replenishing solution preparing part 22, which results in recovering the oxidizing power of the solution 220 containing the overflow OF2. In addition, the oxidizing power of a bleaching agent is further recovered also in the bleach-fixing part 12, and thus a sufficient processing performance of the bleach-fixing solution can be secured.

In the regenerating unit 20, the halide ions accumulated in the overflow OF1 are moved to the electrolyte solution 230 through an anion exchange membrane, and flowing of the unnecessary halide ions in the anode part is prevented. It is not necessarily needed in the cast of a light-sensitive material having only a little affect due to a processing performance by the halide ions, such as a color paper, to provide the solution part 23. However, in a light-sensitive material containing AgI, such as a light-sensitive material for photographing, the affect by the halide ions increases and accordingly, it is preferred to provide the solution part 23.

In the constitution in which the solution part 23 is not provided, the halide ions are moved to the solution 220 contained in the replenishing solution preparing part 22 and contained therein. The content thereof is at a preferable level in accelerating bleaching in a light-sensitive material, such as a color paper.

In the above configuration, the timing for first introducing the solution 210 contained in the overflow processing part 21 into the replenishing solution preparing part 23 is not much more than 2 to 20 minutes after starting the electrification, and thereafter it may be introduced therein at the interval of not much more than 2 to 5 minutes by adapting the timing for introducing the overflow OF1 contained in the bleach-fixing part 12 into the overflow processing part 21. This makes it sufficiently possible to recover silver from the solution 210.

Figure 5:
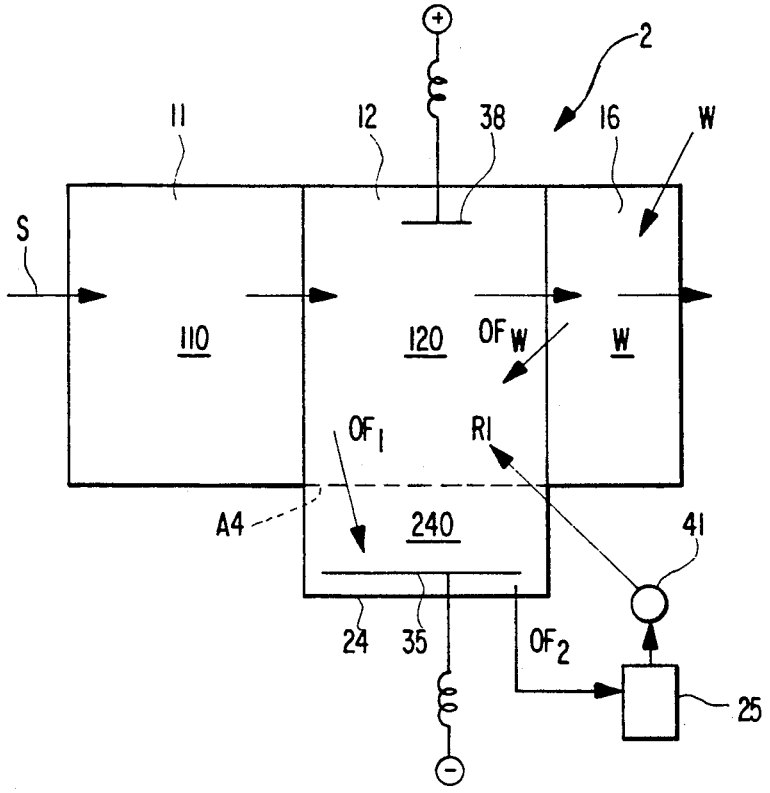
FIG. 5 is a plane figure schematically showing a bath arrangement in a processing equipment used in the present invention.

In FIG. 4, the regenerating unit 20 is designed so as to be separately provided to regenerate the bleach-fixing solution. As shown in FIG. 5, the bleach-fixing solution may be regenerated in the same processing bath. The constitution of FIG. 4 is preferably applied.

The processing equipment 2 shown in FIG. 5 consists of the color developing bath 11 filled with the color developing solution 110, the bleach-fixing part 12 filled with the bleach-fixing solution 120, and the rinsing bath 16 filled with the rinsing water W. The light-sensitive material S such as, for example, a color paper, is transported from bath to bath to subject it to a processing in the order of color developing, bleach-fixing, and rinsing.

Figure 6:
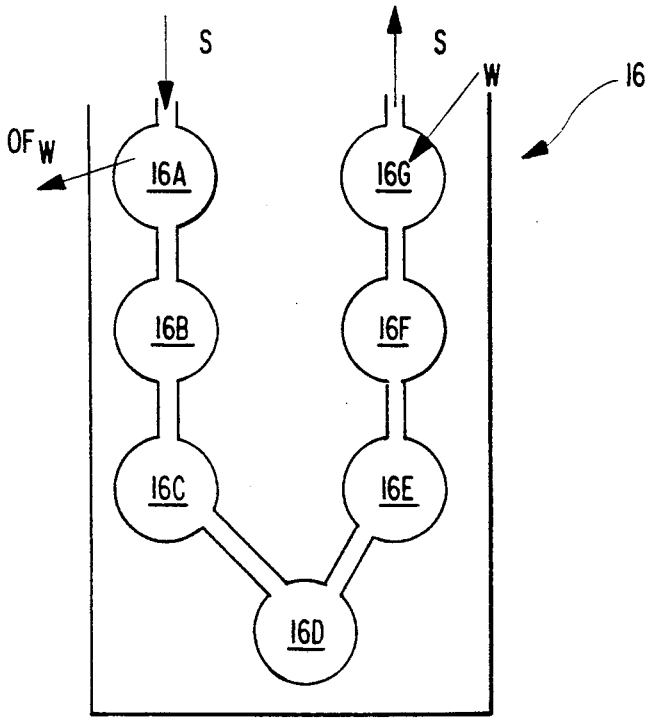
FIG. 6 is a schematic figure showing a structural arrangement of a washing bath in a processing equipment used in the present invention.

In the above configuration, the rinsing bath 16 consists of the seven processing chambers 16A, 16B, 16C, 16D, 16E, 16F, and 16G, and passes with a narrow width are provided between the respective processing chambers. Further, passes with a narrow width for carrying in and out the light-sensitive material S are also provided on the upper part of the processing chambers 16A and 16G. As shown in FIG. 6 by an arrow signal, the rinsing bath 16 is constituted so that the rinsing water W is supplied to the final processing chamber 16G (the seventh chamber) and the overflow OFw is discharged from the processing chamber 16A (the first chamber). The details of this rinsing bath can be referred to JP-A-2-205846.

In the rinsing bath 16 of such constitution, the flowing direction of a rinsing water is opposite to the transporting direction (a counter flow) of the light-sensitive material S, and the concentrations of the agents in the respective processing chambers are high in the processing chamber 16A and low in the processing chamber 16G. In addition, the freshness degree of this rinsing water W is maintained. Accordingly, the rinsing efficiency is excellent and in the rinsing bath of such a constitution, the use of only one bath is sufficient.

The overflow OFw is designed to flow in the bleach-fixing part 12. This enables the waste water amount to decrease.

The processing equipment 2 is provided with the overflow processing part 24 for introducing and storing the overflow OF1 from the bleach-fixing part 12 in the vicinity of the bleach-fixing part 12. The partition wall separating the bleach-fixing solution 120 in the bleach-fixing part from the solution 240 in the overflow processing part 24 consists of the anion exchange membrane A4. There are disposed the anode 38 in the bleach-fixing part 12 and the cathode 35 in the overflow processing part 24, respectively, and these electrodes are of a constitution in which electrification is possible.

Further, the processing equipment 2 is provided with the storage tank 25 for taking out and storing the solution 240 in the overflow processing part 24 after electrifying as the overflow OF2. The agents are added to this storage tank 25 according to necessity, and then the solution contained in the storage tank 25 is replenished to the bleach-fixing part 12 as the replenishing solution $R_1$ via a pump 41.

Also in such a processing equipment 2, the electrification is carried out in the same manner as shown in FIG. 4. The electrifying amount also may be decided according to the above equations (1) and (2).

The electrification leads to removing silver from the solution 240 in the overflow processing part 24, and the solution from which silver has been removed is replenished to the bleach-fixing part 12, whereby an oxidizing power of the bleaching agent is recovered in the bleach-fixing part 12.

The halide ions, such as $Br^-$, are moved to the bleach-fixing solution 120 in the bleach-fixing part 12 via the anion exchange membrane A4 and contained therein. The content of such halide ions is at a preferable level for accelerating bleaching.

In FIG. 5, the movement of the solution between the respective parts by an overflow is caused according to the timing of replenishing, and this sufficiently recovers the processing performance as described above.

Figure 7:
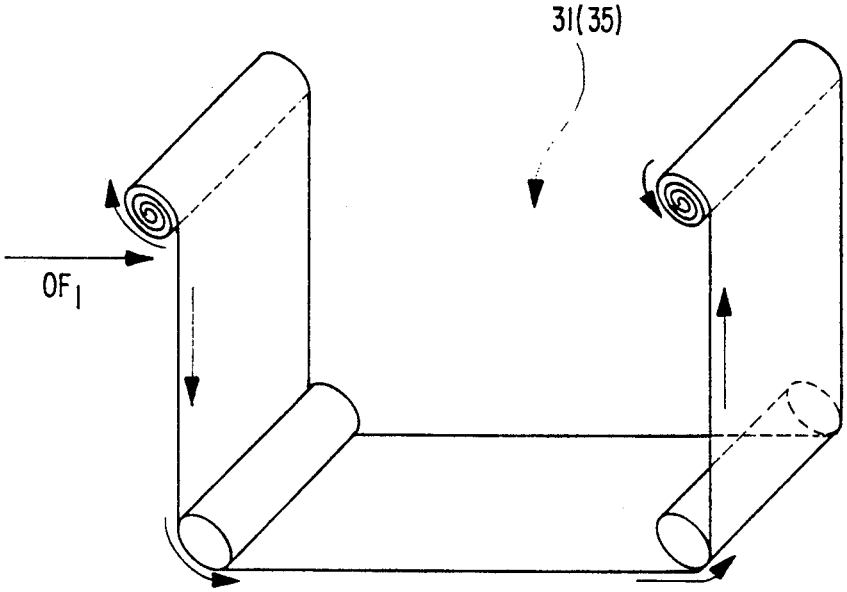
FIG. 7 is a perspective figure schematically showing a structural arrangement of a cathode used in the present invention.

In the constitutions of FIG. 4 and FIG. 5, the cathodes 31 and 35 disposed in the overflow processing parts 21 and 24, respectively, may usually be tabular and are preferably an moving electrode as shown in FIG. 7. This consists of a flexible material and is disposed in the form of a wound roll. It is constituted so that a different portion thereof contacts a solution by rewinding and winding. An unused portion of the cathode is sent out preferably from the side in which the overflow OF1 from the bleach-fixing part 12 is introduced. Thus, metal silver which is once reduced and deposited on the cathode is prevented from reoxidation by winding.

In the above procedure, when the thickness of deposited silver reaches the extent of 0.05 to 5 mm, the cathode is moved continuously or intermittently. In addition, the cathode may be replaced when deposited silver exceeds a prescribed amount.

The processing equipment used in Processing (2) according to the present invention is not limited to the examples shown in the above figures and can be of various constitutions. For example, there can be applied the constitution in which the bleach-fixing part 12 can be directly replenished without providing the storage tank 25. Also, in the constitution shown in FIG. 4, the anode is disposed in the main tank of the bleach-fixing bath, but there may be applied the constitution in which the anode is disposed in a sub tank connected to the main tank and the used bleach-fixing solution is supplied from the sub tank to the generating unit.

The present invention can be applied to various processing steps including a bleach-fixing step and can be of various constitutions according to the processing steps.

In the bleach-fixing processing of Processing (3) according to the present invention, a light-sensitive material is processed while maintaining and recovering the processing performance of a bleach-fixing solution by electrifying via an anion exchange membrane. The above electrification is carried out during processing and non-processing of the light-sensitive material while exchanging the electrodes in the processing solution. During processing, the oxidizing power of the bleach-fixing solution is recovered with the anode dipped therein, and during non-processing, the reducing power of the bleach-fixing solution is recovered with the cathode dipped therein. The combination of the cathode which is dipped in the bleach-fixing solution during processing and the anode paired therewith is preferably kept distinct from the combination of the anode which is dipped in the bleach-fixing solution during non-processing and the cathode paired therewith.

Figure 8:
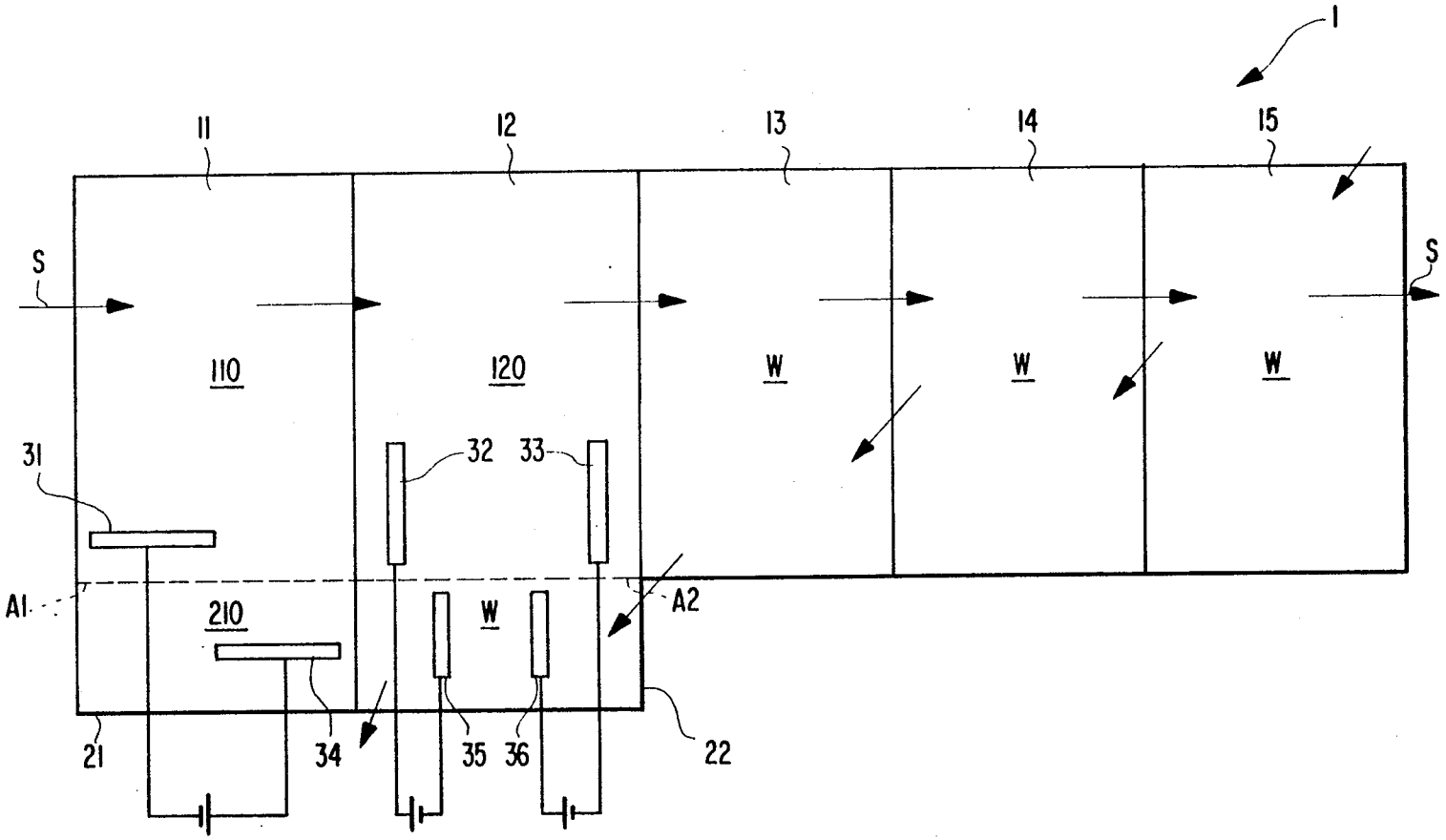
FIG. 8 is a plane figure schematically showing a bath arrangement in a processing equipment used in the present invention.

One constitutional example of the processing equipment used in the present invention is shown in FIG. 8, which is a plane figure showing a bath arrangement.

As shown in FIG. 8, the processing equipment 1 consists of the color developing part 11 filled with the color developing solution 110, the bleach-fixing part 12 filled with the bleach-fixing solution 120, and the first rinsing bath 13, second rinsing bath 14 and third rinsing bath 15 each filled with the rinsing water W. The light-sensitive material S such as, for example, a color paper is transported from bath to bath to subject it to a processing in the order of color developing, bleach-fixing, rinsing, rinsing and rinsing.

The color developing part 11 is provided with the part 21 filled with the aqueous solution 210 in the vicinity thereof, and the partition wall separating the color developing solution 110 from the aqueous solution 210 is composed of the anion exchange membrane Al. Also, the bleach-fixing part 12 is provided with the part 22 filled with the aqueous solution W in the vicinity thereof, and the partition wall separating the bleach-fixing solution 120 from the aqueous solution W is composed of the anion exchange membrane A2.

There are disposed the cathode 31 in the color developing solution 110 in the color developing part 11 and the anode 34 in the part 21, respectively, and these electrodes are of the constitution in which the electrification is possible.

There, are disposed the anode 32 in the bleach-fixing bath 120 in the bleach-fixing part 12 and the cathode 35 in the part 22, respectively, and these electrodes are of the constitution in which electrification is possible. Further, separate from these electrodes 32 and 35, the cathodes 33 and the anode 36 are disposed in the bleach-fixing part 12 and the part 22, respectively. These electrodes are of the constitution in which electrification is possible.

The aqueous solution 210 filled in the part 21 is preferably a freshly prepared solution containing an electrolyte for maintaining a developing performance, or may be the solution in which, for example, the overflow solution of the color developing solution 110 is introduced. Also, the aqueous solution W filled in the part 22 may be a discharging solution overflowing from the first rinsing bath 13.

In the first rinsing bath 13, the second rinsing bath 14 and the third rinsing bath 15, there is applied, in order to improve the rinsing efficiency, a so-called multi-stage countercurrent system in which the rinsing water W is replenished from the third rinsing bath 15 and an overflow solution is replenished from a following bath to a preceding bath.

In the above procedure, electrification is first carried out during processing. In this case, it is carried out primarily using the combination of the cathode 31 dipped in the color developing solution 110 and the anode 34 dipped in the aqueous solution 210 and the combination of the anode 32 dipped in the bleach-fixing solution 120 and the cathode 35 dipped in the aqueous solution W, and the combination of the cathode 33 and the anode 36 is not electrified in principle. That is, the electrification is started to the color developing solution 110 and the bleach-fixing solution 120 as soon as, or a little while after, a signal that starting of the processing of the light-sensitive material S is received. Electrification of the color developing solution 110 is terminated as soon as the processing is over. In the bleach-fixing solution 120, electrification between the anode 32 and the cathode 35 is terminated with the completion of the processing, and electrification between the cathode 33 and the anode 36 in turn is carried out during non-processing, particularly in the heating period.

In the electrification of this case, the voltage may be loaded so that the electric current density becomes 0.5 to 300 mA/cm$^2$ (0.05 to 30 A/dm$^2$), preferably 2 to 60 mA/cm$^2$ (0.2 to 6 A/dm$^2$). The loaded voltage is entirely different according to the solution used, the form of the processing equipment, the distance between the electrodes, and the quality and the kind of a partition wall. In general, it may be 0.05 to 100 V, preferably 0.1 to 10 V.

The above electrification contributes to the recovery of the processing performance of the color developing solution 110 and the bleaching power of the bleach-fixing solution 120 during the processing of the light-sensitive material. In the color developing solution 110, the halogen ions eluted from the light-sensitive material S move to the anode 34 through the anion exchange membrane Al and are removed. Accordingly, the replenishing amount of the color developing solution can be markedly decreased. In addition, an oxidation product of a color developing agent is partly reduced on a cathode. Further, $OH^-$ is partly formed and therefore, an acid eluted from the light-sensitive material S can be neutralized.

In the bleach-fixing solution 120, the deterioration of the oxidation power of the bleaching agent due to the reduction thereof primarily leads lowering of a desilvering performance during processing, but this can be solved. Further, the electrification between the cathode 35 and the anode 32 in processing can provide the effect that the halogen ions contained in the aqueous solution W are moved to the bleach-fixing solution 120, and is not necessary to add a rehalogenating agent.

In the above procedure, an oxidation-reduction potential of the bleach-fixing solution 120 is measured from time to time, and when it falls below a prescribed potential, the switching On and Off of the electrification is preferably controlled so that the voltage is loaded. The above potential may be measured in comparison with an anode potential of a standard hydrogen electrode, or measured with an oxidation-reduction electrometer.

The above potential is different according to the oxidizing agent. It is at a level of 0 to 210 mV, for example, with a ferric ethylenediaminetetracetate complex salt and at the level of 20 to 260 mV with a ferric 1,3-diaminopropanetetracetate complex salt.

In processing of the light-sensitive material, the oxidation-reduction potential (Ered) of the bleach-fixing solution is reduced due to the reduction of bleaching agent therein.

On the other hand, in non-processing of the light-sensitive material, the bleaching agent in the bleach-fixing solution is oxidized by oxygen in air and is partly regenerated. Therefore, Ered of the bleach-fixing solution is increased. In this case, however, the fixing agent contained in the bleach-fixing solution is oxidation deteriorated at the same time.

Accordingly, in the method for processing the light-sensitive material according to the present invention, electrification can be carried out by the following two methods for controlling the electrification that:

(1) (i) in processing the light-sensitive material, electrification is carried out between the cathode 31 and the anode 34 under the conditions of voltage 3 V, current 1 A and time 0.4 to 10 sec. and between the anode 32 and the cathode 35 under the conditions of 3 V, 1 A and 0.2 to 5 sec. every 0.1 dm$^2$ passing of the light-sensitive material, and (ii) in non-processing, electrification is carried out between the cathode 33 and the anode 36 under the conditions of 3 V, 1 A and 0.2 to 5 sec. every 1 to 2 hours; and (2) an equipment for measuring the Ered of the bleach-fixing solution is introduced into the bleach-fixing solution and electrification between the anode 32 and the cathode 35 during processing and electrification between the cathode 33 and the anode 36 during non-processing are controlled so that the Ered of the bleach-fixing solution falls within a prescribed range.

More specifically, in processing of the light-sensitive material, when Ered of the bleach-fixing solution is reduced to, e.g., −100 mV or lower at non-electrification, the electrification is carried out between the anode 32 and the cathode 35 to increase the Ered. When the Ered exceeds +80 mV, the electrification is turned Off. Then, the Ered is measured at an interval of, for example, 1 hour during non-processing, and when the Ered exceeds +100 mV, the electrification is carried out between the cathode 33 and the anode 36. When this electrification drives the Ered of the bleach-fixing solution to, for example, −50 mV to −100 mV, the electrification is turned Off.

As described above, the electrification is carried out between the anode 32 and the cathode 35 with controlling Ered during processing and the electrification is carried out between the cathode 33 and the anode 36 with controlling Ered during non-processing. Thus, it is theoretically possible to permanently repeat the regeneration of the bleach-fixing solution. Further, since Ered is controlled to have a prescribed value, the processing can be conducted without the generation of problems on processing such as desilvering failure and color restoration failure.

Electrification carried out in the above manner can prevent decomposition of the preservative and fixing agent by air oxidation in the heating period during non-processing, and an excellent processing performance can be obtained when starting the processing. Also, the halogen ions contained in the bleach-fixing solution 120 can be removed.

Figure 9:
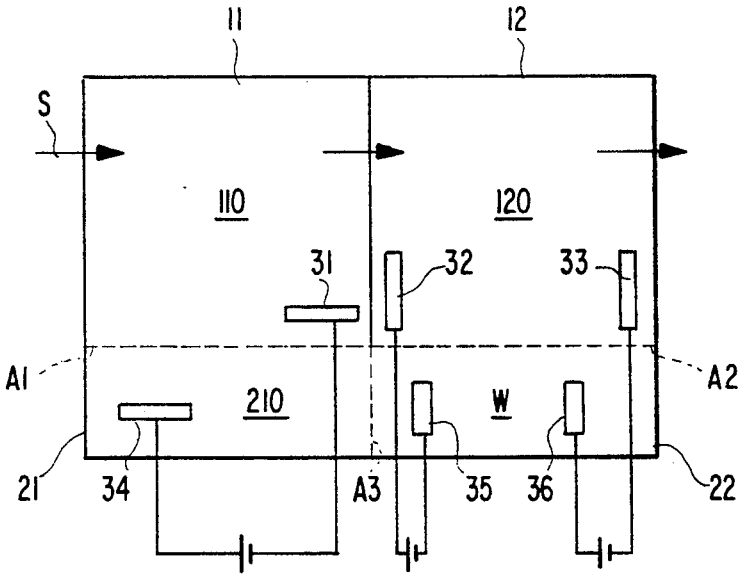
FIG. 9 is a plane figure schematically showing a bath arrangement of a color developing bath and a bleach-fixing bath in a processing equipment used in the present invention.

The processing equipment used in Processing (3) according to the present invention is not limited to the one shown in FIG. 8 and may be the equipment in which the portions of the color developing part 11 and the bleach-fixing part 12 are modified, as shown in FIG. 9.

The processing equipment shown in FIG. 9 is the one in which the partition wall separating the aqueous solution 210 in the part 21 from the aqueous solution W in the part 22 is composed of the anion exchange membrane A3 in the portions of the color developing part 11 and bleach fixing part 12 shown in FIG. 8.

Also in this case, the same electrification as that described above can provide the same effects.

Figure 10:
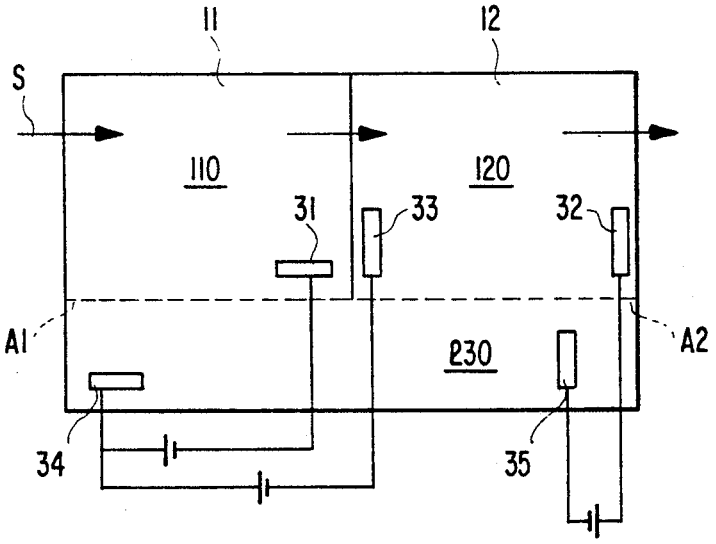
FIG. 10 is a plane figure schematically showing a bath arrangement of a color developing bath and a bleach-fixing bath in a processing equipment used in the present invention.

Further, the portions of the color developing part 11 and the bleach-fixing part 12 may be modified as shown in FIG. 10.

The processing equipment shown in FIG. 10 is different from the one shown in FIG. 8 only in that in the portions of the color developing part 11 and the bleach-fixing part 12, the aqueous solution 230 contacting the color developing solution 110 and the bleach-fixing solution 120, respectively, via the anion exchange membranes A1 and A2 is in the part 23 and that the anode 34 paired with the cathode 33 is paired with the cathode 31 dipped in the color developing solution 110.

In such a constitution, the same effects as those described above can be obtained as well.

Figure 11:
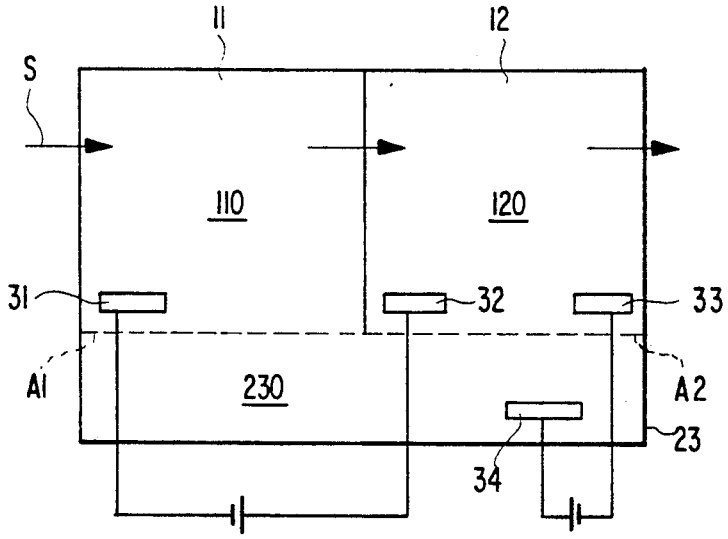
FIG. 11 is a plane figure schematically showing a bath arrangement of a color developing bath and a bleach-fixing bath in a processing equipment used in the present invention.

Further, the portions of the color developing part 11 and the bleach-fixing part 12 may be modified as shown in FIG. 11.

The processing equipment shown in FIG. 11 is different from the one shown in FIG. 10 only in that the cathode 31 dipped in the color developing solution 110 is paired with the anode 32 dipped in the bleach-fixing solution 120.

In such a constitution, the same effects as those described above can be obtained as well. Further, the electrification between the cathode 31 and the anode 32 in processing can provide the effect that the halogen ions contained in the color developing solution 110 are moved to the bleach-fixing solution 120, and is not necessary to add a rehalogenating agent.

In FIG. 10 and FIG. 11, the aqueous solution 230 filled in the part 23 contacts the color developing solution 110 via the anion exchange membrane Al and accordingly, a freshly prepared solution is preferably used rather than utilizing the rinsing solution W, as well as the aqueous solution 210 in the part 21 shown in FIG. 8 and FIG. 9. Also, it may be the solution in which the overflowing solution of the color developing solution 110 is introduced.

The explanations have so far been given according to the examples shown in the figures but the processing equipments used for Processing (3) according to the present invention are not limited thereto and various ones can be used.

It is preferred to dispose both electrodes parallel to an anion exchange membrane in view of the electrification efficiency.

In the present invention, an electrolyte solution may be used. The electrolyte used for the electrolyte solution or a freshly prepared solution is not specifically limited. Preferably used are halides, such as NaCl, KCl, LiCl, NaBr, KBr, and KI; sulfates, such as $Na_2SO_4$ and $K_2SO_4$; nitrates, such as $KNO_3$, $NaNO_3$, and $NH_4NO_3$; and carbonates, such as $Na_2CO_3$ and $K_2CO_3$.

The concentration of the electrolyte in the solution is 0.1 to 30%, preferably 0.5 to 20%.

In some cases, the electrification can be carried out in such a manner that the bleach-fixing solution is filled so that the bleach-fixing solutions themselves contact each other via an anion exchange membrane in a part of the plural parts filled with the bleach-fixing solution.

In the present invention, the electrification can reduce the replenishing amount of the bleach-fixing solution. For example, it can be reduced by 20 to 80% as compared with a usual replenishing amount and by 10 to 50% as compared with the case in which electrification is carried out with a cathode or anode dipped in a bleach-fixing solution contained in a single bath.

The processing time in bleach-fixing in a usual replenishing condition can be shortened by 10 to 40% as compared with the usual processing time.

The cathode used in the present invention may be anyone as long as it is an electroconductive material or a semiconductor and it can be used for a long time. For example, a metal material, such as stainless steel, aluminum, silver, nickel, copper, zinc, brass, and titanium, can be used. Particularly preferred is stainless steel.

The anode may be anyone as long as it is an insoluble material and an electroconductive material. For example, carbon (graphite), lead dioxide, platinum, gold, and titanium steel, can be used. In some cases, stainless steel may be used.

The forms of both electrodes are preferably a plate which is easy to install in a bath, a plate having a mesh, or a plate having a projection. The size thereof can be arbitrarily selected according to the bath volume.

When the cathode is a moving electrode as shown in FIG. 7, there can be used a so-called flexible cathode material, such as a metal foil and a metal fiber of the above cathode materials; a woven cloth or unwoven cloth consisting of a carbon fiber, a glass fiber or a resin fiber, on which the above metal materials are plated. An unwoven cloth on which a stainless steel foil or a silver plating is provided is preferably used.

The discharged solution of a rinsing water may be used as a electrolyte solution. Also when an ion exchanged water is used as a rinsing water, the salts which are the components for the bleach-fixing solution carried in by the light-sensitive material are mixed in the used rinsing water. Accordingly, no problems arise in using it as the electrolyte solution. This contributes to the reduction of a waste water amount. The above rinsing water may be a usual one, and is preferably one containing a preservative, an anti-mold agent, a dye eluting agent, and a decoloring agent, such as wash water disclosed in JP-A-2-242249.

The anion exchange membrane used in the present invention may be anyone as long as it permeates selectively the anions, and the ones commercially available can be used as they are. For example, the anion exchange membrane may be commercially available under the brands, such as Selemion AMV/AMR and Selemion ASV/ASR manufactured by Asahi Glass Co., Ltd.; Aciplex A 210 and A 172 manufactured by Asahi Kasei Ind. Co., Ltd.; Neosepta AM-1 to 3, Neosepta AFN-7 and Neosepta ACS manufactured by Tokuyama Soda Ind. Co., Ltd.; Ionac MA-3148 manufactured by Ionac Chemicals Co., Ltd.; and Nepton AR103PZL manufactured by Ionics Co., Ltd.

In the present invention, the above anion exchange membrane is a general term for a membrane which selectively permeates an anion. In such a sense, porous ceramics having a pore size of 0.2 to 20 μm are included therein.

The bleach-fixing agent used in the present invention will be described below. There can be given as a bleaching agent used for the bleach-fixing solution, for example, the compounds of polyvalent metals such as iron (III), cobalt (III), chromium (VI), and copper (II), peracids, quinones, and nitro compounds. There can be used as a representative bleaching agent, ferricyanides; bichromates; an organic complex salt of iron (III) or cobalt (III), for example, the complex salts of aminopolycarboxylic acids such as ethylenediaminetetra-acetic acid, diethylenetriaminepentacetic acid, cyclohexanediaminetetracetic acid, methyliminodiacetic acid, 1,3-diaminopropanetetracetic acid, and glycol ether diaminetetracetic acid, citric acid, tartaric acid, and malic acid; persulfates; bromates; permanganates; and nitrobenzenes. Among them, the aminopolycarboxylic acid iron (III) complex salts including an ethylenediamine-tetracetic acid iron (III) complex salt and the persulfates are preferred from the viewpoint of rapid processing and the prevention of environmental pollution. Further, the aminopolycarboxylic acid iron (III) complex salts are particularly useful. The bleach-fixing solution in which these aminopolycarboxylic acid iron (III) complex salts are used usually has pH of 5.5 to 8. Processing can be carried out at lower pH for the purpose of accelerating the processing.

A bleaching accelerator can be used according to necessity. Concrete examples of useful bleaching accelerators are described in the following specifications: the compounds having a mercapto group or a disulfide group, described in U.S. Pat. No. 3,893,858, German Patent 1,290,812, JP-A-53-95630, and Research Disclosure No. 17129 (July 1978); the thiazolidine derivatives described in JP-A-50-140129; the thiourea derivatives described in U.S. Pat. No. 3,706,561; iodides described in JP-A-58-16235; the polyoxyethylene compounds described in German Patent 2,748,430; the polyamine compounds described in JP-B-45-8836; and bromide ions. Among them, the compounds having a mercapto group or a disulfide group are preferred from the viewpoint of a larger bleaching acceleration effect. Particularly preferred are the compounds described in U.S. Pat. No. 3,893,858, German Patent 1,290,812, and JP-A-5395630. Further, the compounds described in U.S. Pat. No. 4,552,834 are also preferred.

There can be given as a fixing agent used for the bleach-fixing agent, thiosulfates, thiocyanates, a thioether compound, thioureas, and many iodide salts. In general, the thiosulfates are used, and in particular, ammonium thiosulfate can be most widely used. Also, preferred as a preservative are sulfites, bisulfites, sulfinates and an adduct of carbonyl bisulfurous acid.

The light-sensitive material used in the present invention is a color light-sensitive material. There can be given as such including the ones described above, for example, a color paper, a color negative film, a color reversal film, a color positive film, a color reversal photographic paper, and a photographic light-sensitive material for photomechanical process.

The present invention can be applied to any of the steps in which these light-sensitive materials are subjected to a bleach-fixing processing.

In the processing of a color light-sensitive material, a color developing solution is used in combination with a bleach-fixing solution, and in addition, there are used according to a processing step, the various processing solutions, such as a bleaching solution, a fixing solution, and further a rinsing water and a stabilizing solution. The details of these processing solutions and processing conditions are described in JP-A-63-70857 and JP-A-1-190889.

The present invention will be concretely explained below with reference to the following non-limiting examples.

EXAMPLE 1

Color paper used in Example 1 of JP-A-63-70857 as a sample P1 (a coated silver amount: 0.72 g/m$^2$) was used and image-wise exposed. Then, it was subjected to a running processing for five rounds with a modified processing equipment PP600 manufactured by Fuji Photo Film Co., Ltd. (in which a bleach-fixing part is modified so that an anion exchange membrane can be installed) in a color developing solution according to the processing steps shown in Table 1.

TABLE 1

| Processing step | Time | Temperature (°C.) | Replenishing amount (ml) | Tank capacity (liter) |
|---|---|---|---|---|
| Color developing | 1 min & 40 sec | 38 | 24 | 16 |
| Bleach-fixing | 1 min | 33 | 13 | 10 |
| Rinsing (1) | 20 sec | 33 | — | 3.5 |
| Rinsing (2) | 20 sec | 33 | — | 3.5 |
| Rinsing (3) | 20 sec | 33 | 30 | 3.5 |
| Drying | 50 sec | — | — | — |

Note:
1. Rinsing: a three stage countercurrent system with a current direction from (3) to (1).
2. Replenishing amount per meter of the light-sensitive material with the width of 82.5 mm.

The color developing solution and bleach-fixing solution each used at the processing steps shown in Table 1. are shown in Tables 2 and 3, respectively.

TABLE 2

| Color developing solution | Mother solution | Replenishing solution |
|---|---|---|
| Water | 800 ml | 800 ml |
| 1-Hydroxyethylidene-1,1-diphosphonic acid (60% solution) | 1.5 ml | 1.5 ml |
| Diethylenetriaminepentacetic acid | 1.0 g | 1.0 g |
| Benzyl alcohol | 16 ml | 20 ml |
| Diethylene glycol | 10 ml | 10 ml |
| Sodium sulfite | 2.0 g | 2.5 g |
| Hydroxylamine sulfate | 3.0 g | 3.5 g |
| Potassium bromide | 1.0 g | — |
| Sodium carbonate | 30 g | 35 g |
| Disodium 4,5-dihydroxy-m-benzenedisulfonate | 1.0 g | 1.1 g |
| Fluorescent whitening agent (a stilbene type) | 1.0 g | 1.5 g |
| N-ethyl-N-(β-methanesulfoneamidethyl)-3-methyl-4-aminoaniline sulfate | 6.0 g | 8.0 g |
| Water was added to | 1000 ml | 1000 ml |
| pH | 10.25 | 10.60 |

TABLE 3

| Bleach-fixing solution | Mother solution | Replenishing solution |
|---|---|---|
| Water | 400 ml | 400 ml |
| Ammonium thiosulfate (70%) | 150 ml | 200 ml |
| Sodium sulfite | 18 g | 25 g |
| Ammonium iron (III) ethylenediaminetetracetate | 55 g | 65 g |
| Ethylenediaminetetracetic acid | 5 g | 10 g |
| Water was added to | 1000 ml | 1000 ml |
| pH (adjusted with aqueous ammonia or acetic acid) | 6.75 | 6.50 |

A rinsing water shown below was used.

RINSING WATER (COMMON TO BOTH OF MOTHER SOLUTION AND REPLENISHING SOLUTION)

There was used well water with the quality shown in Table 4, which was introduced into a column filled with an H type strong acid cation exchange resin (Diaion SA-1B manufactured by Mitsubishi Chemicals Ind. Co., Ltd.) and an OH type strong base anion exchange resin (Diaion SA-10A manufactured by Mitsubishi Chemicals Ind. Co., Ltd.) to thereby subject it to a softening processing.

TABLE 4

| | Before IXP* | After IXP* |
|---|---|---|
| pH | 6.8 | 6.6 |
| Calcium ion | 31 mg/l | 0.4 mg/l |
| Magnesium ion | 11 mg/l | 0.1 mg/l |
| Chlorine ion | 30 mg/l | 0.6 mg/l |
| Distillation residue | 150 mg/l | 8.7 mg/l |

*Ion exchange processing.

The amount of the color developing solution carried in the bleach-fixing bath with the light-sensitive material was 32 ml/m$^2$ of the light-sensitive material.

The above processing was designated as Processing 1A.

Processing was carried out in the same manner as Processing 1A with the processing equipment replaced with one of the same constitution as that shown in FIG. 1 except that the bleach-fixing bath 12 shown in FIG. 1 was changed as shown below. That is, a single bleach-fixing bath was employed, and the bleach-fixing solution and the aqueous solution (a 3% solution of the bleach-fixing solution) were filled therein so that they were contacted to each other via an anion exchange membrane, whereby the constitution was employed in which there were dipped an anode in the bleach-fixing solution and a cathode in the aqueous solution, respectively, whereby both electrodes are of a constitution in which they can be electrified. This aqueous solution was employed only for the purpose of providing the electrode, and the overflow of the first rinsing bath 13 was let flow during the processing.

As the cathode a stainless steel containing molybdenum (corresponding to SUS 316) sheet (NTK 316 with a size of 15 cm×100 cm and a thickness of 1 mm, manufactured by Nippon Metal Ind. Co., Ltd.) was used and, as the anode, a carbon sheet (Kuresheet with a size of 15 cm×100 cm and a thickness of 1 mm, manufactured by Kureha Chemical Ind. Co., Ltd.) was used.

Neosepta AM-3 (Tokuyama Soda Co., Ltd.) was used as the anion exchange membrane.

The electrifying condition was such that a voltage of 3 V was loaded and an electric current of 1.0 A was let flow (the electric current density: 0.3 A/dm$^2$).

The voltage was loaded one minute after a processing signal for a light-sensitive material was received, and when the processing signal was not received for 20 minutes, the voltage was turned off. The above processing was designated as Processing 1B.

Processing was carried out in the same manner as Processing 1B except that there were provided the cathode in the bleach-fixing bath and the anode in the aqueous solution, respectively. This was designated as Processing 1C.

Processing was carried out in the same manner as Processing 1B except that the processing equipment shown in FIG. 1 was used. This was designated as Processing 1D.

The generation of bad desilvering and bad recoloring was checked in Processings 1A, 1B, 1C and 1D. In the desilvering, a residual silver amount of 5 μg/cm$^2$ or more; which was measured with silver analysis by a fluorescent X-ray, was regarded as the generation of bad desilvering. Bad color reproduction was evaluated by an increase in the density of the light-sensitive material at a red color transmitting density of 1.2, which was caused by a reprocessing, wherein the light-sensitive material subjected to a sensitometric exposure and then to processing was subjected to a measurement of the density with a red color and then was subjected once again to the processing starting from the bleach-fixing to measure the density once again. An increase in a density of 0.1 or more was deemed as the generation of bad recoloring.

In Processing 1A, the replenishing amount of the bleach-fixing solution set at an amount less than 13 ml as described above caused bad desilvering and recoloring, and it was impossible to reduce more than this level.

The replenishing amount was set at 10 ml per meter of the light-sensitive material with a width of 8.25 mm in Processing 1B and 11 ml in Processing 1C, whereby excellent photographic performances were obtained. On the contrary, in Processing 1D, excellent photographic performances could be obtained even with a replenishing amount of 4 ml. Further, in Processing 1D, the processing time in the bleach-fixing could be 50 seconds while maintaining the replenishing amount at 4 ml.

The processings were carried out in the same manner as Processing 1D except that the bleach-fixing baths in the processing equipment were replaced with the ones shown in FIGS. 2 and 3, respectively only to find that the same excellent results as those obtained in Processing 1D were obtained. Further, the replenishing amount set at 3 ml could provide the excellent results as well.

EXAMPLE 2

The same processing as Processing 1A in Example 1 is called herewith as Processing 2A.

A processing was carried out in the same manner as Processing 1A except that the processing equipment was replaced with the one shown in FIG. 4, provided that the solution part was not provided between the overflow processing part for processing the overflowing solution of the bleach-fixing solution and the replenishing solution preparing part. A stainless steel containing molybdenum (corresponding to SUS 316) sheet (NTK 316 manufactured by Nippon Metal Ind. Co., Ltd.) was used as the cathodes disposed in the overflow processing part and the solution part adjacent to the bleach-fixing bath. The size of the cathode disposed in the overflow processing part was set at 5 cm×15 cm (a thickness of 1 mm) and that of the cathode disposed in the solution part was set at 15 cm×100 cm (a thickness of 1 mm). A carbon sheet (Kuresheet manufactured by Kureha Chemical Ind. Co., Ltd.) was used as the anodes disposed in the replenishing solution preparing part and the bleach-fixing part. The size of the anode disposed in the replenishing solution preparing part was set at 5 cm×15 cm (a thickness of 1 mm) and that of the anode disposed in the bleach-fixing part was set at 15 cm×100 cm (a thickness of 1 mm). Neosepta AFN-7 (Tokuyama Soda Co., Ltd.) was used as the anion exchange membrane.

Further, a fresh replenishing solution for the bleach-fixing solution was first filled in the overflow processing part and replenishing solution preparing part. The overflowing solution from the first rinsing bath was let flow in the solution part adjacent to the bleach-fixing part.

The electrifying condition was that a voltage of 3.2 V was loaded and an electric current of 2.3 A was let flow in the overflow processing part and replenishing solution preparing part (an electric current density: 3

A/dm$^2$). In the bleach-fixing part and solution part, a voltage of 2.9 V was loaded and an electric current of 2.3 A was let flow (an electric current density: 0.15 A/dm$^2$). This electrifying condition was set up based on the values calculated according to the foregoing equations (1) and (2) using a coated silver amount and a processing amount (a replenishing amount for a bleach-fixing solution) of the light-sensitive material, and the amount of the color developing solution carried in the bleach-fixing part. That is, it was settled for the purpose of recovering silver in the overflow processing part and for the purpose of oxidizing iron (II) to iron (III) in the bleach-fixing part. The voltage was loaded one minute after a processing signal for the light-sensitive material was received, and when the processing signal for the light-sensitive material was not received for 20 minutes, the voltage was turned off. The first introduction of the solution in the overflow processing part into the replenishing solution preparing part after electrifying was started two minutes after starting the electrification, and was let flow in every fixed time (2 to 5 minutes). This was designated as Processing 2B.

Processing was carried out in the same manner as Processing 2B except that the cathode disposed in the overflow processing part was replaced with the moving type electrode shown in FIG. 7. This electrode was made of stainless steel and was of a roll shape with a thickness of 80 μm (a roll width of 5 cm and a length of 30 m, manufactured by Kawasaki Steel Manufacturing Co., Ltd.) was used. The moving distance was set at 3 mm per 10 minutes of electrifying time. That is, it was moved when the thickness of deposited silver became not much more than 2 mm. This processing was designated as Processing 2C.

Processing was carried out in the same manner as Processing 2C except that the moving type electrode was replaced with an Orinon EM series (manufactured by Kanai Juyo Ind. Co., Ltd.). This electrode was made of an unwoven cloth of a synthetic fiber subjected to plating with silver and was of a roll shape with a roll width of 5 cm, a length of 50 m and a thickness of 0.5 mm. This processing was designated as Processing 2D.

In Processings 2B, 2C and 2D, the solution contained in the replenishing solution preparing part after processing was let flow in a stock tank, and 10 ml of regenerating agent A and 35 g of regenerating agent B per liter of the solution were added therein as shown in Table 5, and the solution thus prepared was replenished to the bleach-fixing part.

TABLE 5

| Regeneration agent for a bleach-fixing solution | A | B |
|---|---|---|
| Ammonium thiosulfate (70%) | 100 ml | — |
| Sodium sulfite | 10 g | — |
| Iron (III) ammonium ethylenediaminetetracetate | — | 30 g |
| Ethylenediaminetetracetic acid | — | 5 g |

The generation of bad desilvering and bad recoloring was checked in Processings 2A, 2B, 2C and 2D. In the desilvering, a residual silver amount of 5 μg/cm$^2$ or more, which was measured with a silver analysis by a fluorescent X-ray, was regarded as the generation of bad desilvering. The bad recoloring was evaluated by an increase in the density of the light-sensitive material at a red color transmitting density of 1.2, which was caused by reprocessing, wherein the light-sensitive material subjected to a sensitometric exposure and then to processing was subjected to a measurement of the density with a red color and then was subjected once again to the processing starting from the bleach-fixing to measure the density once again. An increase in a density of 0.1 or more was deemed as the generation of bad color reproduction.

In Processing 2A, the replenishing amount of the bleach-fixing solution set at an amount less than 13 ml as described above caused bad desilvering and recoloring, and it was impossible to reduce more than this level. On the contrary, the generation of bad desilvering and bad recoloring was not observed even with a replenishing amount of 7 ml per meter of the light-sensitive material with a width of 8.25 mm and a length of 1 m in Processing 2B and with that of 3.5 ml in Processings 2C and 2D.

It can be found from the above results that the used amount of the bleach-fixing solution can be reduced in Processings 2B, 2C and 2D, since the solution prepared by adding the regenerating agent to the overflowing solution utilized is used as the replenishing solution and in addition, the replenishing solution itself also can be reduced.

There was applied the conventional process in which an overflow was filled via a partition wall, such as Yumicron, and was subjected to an electrolysis. The regenerating agents A and B were added to the regenerated solution as described above and was used as a replenishing solution. It was found that sufficient photographic performances could not be obtained without making the replenishing amount 11 ml or more. In addition, it was found that the results were unsatisfactory in terms of the generation of bad desilvering and bad recoloring. Further, there was applied to this process, the method according to JP-B-57-16345, in which oxygen was blown in a vicinity of an anode. It was also found that sufficient photographic performances could not be obtained without making the replenishing amount 9 ml or more and that the results were unsatisfactory particularly in terms of the generation of bad desilvering.

EXAMPLE 3

Processing 2A in Example 2 was repeated except that the processing equipment was replaced with the one shown in FIG. 5, wherein the same electrode as the anode disposed in the bleach-fixing part in Processing 2B of Example 2 was used for an anode disposed in the bleach-fixing part, while the same electrode as the moving type cathode disposed in the overflow processing part in Processing 2C of Example 2 was used for the cathode disposed in the overflow processing part. The rinsing bath was composed of seven processing chambers as shown in FIG. 6 and the volume per each processing chamber was set at 500 ml. Further, a fresh replenishing solution for the bleach-fixing solution was first filled in the overflow processing part. The overflow from the rinsing bath was introduced in the bleach-fixing part.

The electrifying condition was that a voltage of 2.9 V was loaded and an electric current of 2.3 A was let flow (an electric current density: 0.15 A/dm$^2$). This electrifying condition was set up according to the foregoing equations (1) and (2) and based on the equation (2) aimed at oxidizing iron (II) to iron (III). Similarly to Example 2, the voltage was loaded one minute after a processing signal for the light-sensitive material was received, and when the processing signal for the light-sensitive material was not received for 20 minutes, the voltage was turned off.

The solution after electrifying in the overflow processing part was introduced in a stock tank and there were added thereto regenerating agent A of Table 5 in a ratio of 20 ml per liter of the solution and regenerating agent B of Table 5 in a ratio of 7 g per liter of the solution. The solution thus prepared was added to the bleach-fixing part as the replenishing solution. This processing was designated as Processing 3B.

In Processing 3B, the generation of bad desilvering and bad recoloring was not observed even with the replenishing amount of the bleach-fixing solution reduced up to 2 ml using the above replenishing solution. Further, the replenishing amount of the rinsing water could be set at 6 ml, and no generation of bad rinsing was observed even at this level. Thus, it was found that in Processing 3B, there can be reduced the amount of the overall waste water by up to 43% and the amounts of the bleach-fixing solution and rinsing water by up to 14%.

EXAMPLE 4

Color paper used in Example 1 of JP-A-63-70857 as a sample P1 (a coated silver amount: 0.72 g/m$^2$) was used and image-wise exposed. Then, it was subjected to a running processing for three months with a modified equipment of the processing equipment PP600 manufactured by Fuji Photo Film Co., Ltd. (in which a bleach-fixing part is modified so that an anion exchange membrane can be installed) according to the processing steps shown in Table 1, wherein the running processing was carried out for one week with the processed amount of the color paper set at 50 m$^2$ per day, the warm-tone time set at 15 hours per day and the processing time set at 10 hours per day. Next, running processing was carried out for another one week with the processed amount of the color paper set at 0.5 m$^2$ per day, the warm-tone time set at 15 hours per day and the processing time set at 30 hours per day; and this was repeated alternately.

The solutions shown in Tables 2 and 3 each were used as the color developing solution and bleach-fixing solution which were used at the steps shown in Table 1.

Further, the same solution as that used in Example 1 was used as the rinsing water.

The amount of the color developing solution carried in the bleach-fixing part with the light-sensitive material was 32 ml/m$^2$ of the light-sensitive material.

The above processing was designated as Processing 4A.

Processing was carried out in the same manner as Processing 4A with the processing equipment replaced with the one shown in FIG. 8 except that the electrodes 33 and 36 disposed in the bleach-fixing part 12 shown in FIG. 8 were removed. That is, only an anode was dipped in the bleach-fixing solution. As the cathode, a stainless steel containing molybdenum (corresponding to SUS 316) sheet (NTK 316 with a size of 15 cm×100 cm and a thickness of 1 mm, manufactured by Nippon Metal Ind. Co., Ltd.) was disposed in the color developing part 11 and part 22, and, as the anode, a carbon sheet (Kuresheet with a size of 15 cm×100 cm and a thickness of 1 mm, manufactured by Kureha Chemical Ind. Co., Ltd.) was disposed in the bleach-fixing part 12 and part 21.

Neosepta AM-3 (Tokuyama Soda Co., Ltd.) was used as the anion exchange membrane. A 3% KCl aqueous solution was filled in the part 21. The overflowing solution from the first rinsing bath 13 was let flow in the part 22, and the solution which was first filled therein was a 3% solution of the bleach-fixing solution.

The electrifying condition was that a voltage of 3 V was loaded and an electric current of 1.0 A was let flow (the electric current density: 0.3 A/dm$^2$).

The voltage was loaded one minute after a processing signal for the light-sensitive material was received, and when the processing signal was not received for 20 minutes, the voltage was turned off. The above processing was designated as Processing 4B.

Processing was carried out in the same manner as Processing 4B except that the electrodes 32 and 35 were replaced with the electrodes 33 and 36 in the bleach-fixing part 12, that is, only the cathode was dipped in the bleach-fixing solution, wherein the same electrodes and electrifying conditions as those applied in Processing 4B were applied. This was designated as Processing 4C.

Processing was carried out in the same manner as Processing 4C except that the electrification was carried out only during non-processing at the above conditions in such a manner that the electrification was carried out for 20 minutes when a warm-tone time lasted for two hours or more and for 20 minutes when it lasted for another two hours or more. This was designated as Processing 4D.

Processing was carried out in the same manner as Processing 4A except that the processing equipment was replaced with the one shown in FIG. 8. The same electrodes and others as those used in Processing 4B were used. The voltage was loaded in the color developing part 11 in the same manner as Processing 4B. In the bleach-fixing part 12, the voltage was loaded one minute after a processing signal for a light-sensitive material was received, and the electrification was carried out between the electrodes 32 and 35 during the processing while monitoring the potential of the solution, wherein the electrification was stopped when the potential exceeded +80 mV. Further, when the processing signal for the light-sensitive material was not received for 20 minutes, the voltage was turned off, and when three hours passed from the turning off of the voltage, the electrification was carried out between the electrodes 33 and 36, wherein the electrification was stopped when the potential became −100 mV or less. This was designated as Processing 4E.

The generation of bad desilvering and bad recoloring was checked in Processings 4A, 4B, 4C, 4D and 4E. In the desilvering, a residual silver amount of 5 μg/cm$^2$ or more, which was measured with a silver analysis by a fluorescent X-ray, was regarded as the generation of bad desilvering. The bad recoloring was evaluated by an increase in the density of the light-sensitive material at a red color transmitting density of 1.2, which was caused by a reprocessing, wherein the light-sensitive material subjected to a sensitometric exposure and then to a processing was subjected to a measurement of the density with a red color and then was subjected once again to the processing starting from the bleach-fixing to measure the density once again. An increase in a density of 0.1 or more was deemed as the generation of bad recoloring.

In Processing 4A, the replenishing amount of the bleach-fixing solution set at an amount less than 13 ml as described above caused bad desilvering and recoloring, and it was impossible to reduce more than this level.

The replenishing amount was set at 6 ml per meter of the light-sensitive material with a width of 8.25 mm and a length of 1 m in Processing 4B, 10 ml in Processing 4C and 4 ml in Processing 4D, whereby excellent photographic performances were obtained. On the contrary, in Processing 4E, excellent photographic performances could be obtained even with the replenishing amount of 3 ml.

The processings were carried out in the same manner as Processing 4E except that the constitutions of the color developing part 11 and bleach-fixing part 12 in the processing equipment were changed to the ones shown in FIGS. 9, 10 and 11, respectively only to find that the same excellent results as those obtained in Processing 4E were obtained.

According to the present invention, processing can be carried out while readily maintaining and controlling the processing performance of the bleach-fixing agent. This results in enabling the used amount of the bleach-fixing solution to be reduced without generating bad desilvering and bad recoloring.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide light-sensitive material comprising the steps of:

(A) subjecting an image-wise exposed silver halide light-sensitive material to color development processing and (B) subjecting the resulting processed material to bleach-fixing processing in a bleach-fixing bath containing a bleach-fixing solution, wherein said bleach-fixing bath containing the bleach-fixing solution is divided into plural parts along the path of the carried light-sensitive material by at least one anion exchange membrane, wherein an anode is disposed in the upstream part and a cathode is disposed in the downstream part; and wherein electrification is carried out between the anode and the cathode in the bleach fixing bath during processing of the light-sensitive material.

2. The method of claim 1, wherein the bleach-fixing solution is replenished by a countercurrent replenishing system.

3. A method for processing a silver halide light-sensitive material comprising the steps of:

(A) subjecting an image-wise exposed silver halide light-sensitive material to color development processing and;

(B) subjecting the resulting processed material to bleach-fixing processing in a bleach-fixing bath containing a bleach-fixing solution, wherein said bleach-fixing solution is stored in a storing bath after use in the bleach-fixing bath, wherein said storing bath is divided into plural parts by an anion exchange membrane, wherein a cathode is disposed in part (A) which the bleach-fixing solution enters and an anode is disposed in part (B) from which the bleach-fixing solution returns to the bleach-fixing bath wherein the bleach-fixing solution moves from part (A) to part (B); and wherein the bleach-fixing solution stored in said storing bath is subjected to electrification between the anode and the cathode, wherein silver is removed in part (A) and a bleaching agent is regenerated in part (B).

4. The method of claim 3, wherein said storing bath is divided into more than two parts and the part without the anode or the cathode is disposed between part (A) and part (B).

5. The method of claim 3, wherein the cathode disposed in the upstream is a flexible electrode.

6. A method for processing silver halide light-sensitive material comprising the steps of:

(A) subjecting an image-wise exposed silver halide light-sensitive material to color development processing in a color developing bath containing a color developing solution and;

(B) subjecting the resulting processed material to bleach-fixing processing in a bleach-fixing bath containing a bleach-fixing solution, wherein said bleach-fixing bath is divided into plural parts by at least one anion exchange membrane, wherein a first anode and a second cathode are together disposed in the upstream part of said bleach-fixing bath and a first cathode and a second anode are together disposed in the downstream part of said bleach-fixing bath, wherein electrification is carried out between said first anode and said first cathode during processing of the light-sensitive material, and wherein electrification is carried out between said second cathode and said second anode during non-processing.

7. The method of claim 6, wherein the bath in the downstream of said bleach-fixing bath comprises an overflow solution of another processing solution or an electrolytic solution.

* * * * *